US006067979A

United States Patent [19]

Jaasma et al.

[11] Patent Number: 6,067,979

[45] Date of Patent: May 30, 2000

[54] COMBUSTION SYSTEM

[75] Inventors: Dennis R. Jaasma; Mark R. Champion, both of Blacksburg, Va.

[73] Assignee: Dennis Jaasma, Blacksburg, Va.

[21] Appl. No.: 09/129,125

[22] Filed: Aug. 4, 1998

[51] Int. Cl.[7] ..... F23B 5/00; F23K 3/16; F24B 1/16

[52] U.S. Cl. ..... 126/77; 126/73; 126/163 R; 126/152 R; 126/287; 110/211; 110/229; 110/214; 110/116; 110/118; 110/293

[58] Field of Search ..... 126/73, 77, 163 R, 126/163 A, 152 R, 289, 287, 152 B, 15 R; 110/229, 204, 210, 205, 231, 211, 214, 230, 293, 294, 116, 117, 118

[56] References Cited

U.S. PATENT DOCUMENTS

| | | | |
|---|---|---|---|
| 1,643,026 | 9/1927 | Molby . | |
| 4,201,186 | 5/1980 | Panquin | 126/83 |
| 4,335,702 | 6/1982 | Jarboe | 126/77 |
| 4,606,282 | 8/1986 | Steindal | 110/293 |
| 4,862,869 | 9/1989 | Hazard | 110/211 |
| 4,984,560 | 1/1991 | Hazard . | |

FOREIGN PATENT DOCUMENTS

| | | | |
|---|---|---|---|
| 51386 | 6/1942 | France | 126/73 |
| 1020228 | 2/1953 | France | 126/73 |
| 143707 | 11/1935 | Germany | 110/293 |
| 579490 | 7/1958 | Italy | 110/117 |
| 2072831 | 10/1981 | United Kingdom | 126/77 |
| 2172989 | 10/1986 | United Kingdom | 126/77 |

*Primary Examiner*—Carl D. Price
*Attorney, Agent, or Firm*—Whitham, Curtis & Whitham

[57] ABSTRACT

A combustion system includes a primary combustion chamber divided into left and right sides by fuel-retaining standards defining a canyon or void extending into a secondary combustion chamber is provided. The floor of the primary combustion chamber and the fuel-retaining standards direct the burning solid fuel toward the lower part of the canyon, while at the same time retaining the non-burning solid fuel on either side of the fuel-retaining standards. The combustion system further includes an air delivery system having a lower air tube supplying high and low velocity air and an upper air tube. The lower air tube is positioned proximate to a firebox floor, while the upper air tube is positioned within the secondary chamber. Automatic air setting mechanisms are provided so that proper air settings can be maintained during various phases of a fire. The combustion system further includes a loading door having openings and a bypass system preventing the loading door from being fully closed unless the bypass is in the completely closed position. The secondary combustion chamber includes at least fuel protecting baffles and a secondary combustion chamber ceiling which extends partially over the entire length of the secondary combustion chamber or includes openings. A catalyst mounting system which minimizes canning and masking and a radiant catalyst heating system are also provided.

30 Claims, 12 Drawing Sheets

*I - I*

I–I

COMBUSTION SYSTEM

BACKGROUND OF THE INVENTION

1. Field of the Invention

The present invention generally relates to a combustion system for improved combustion of solid fuels and, more particularly, to a combustion system which prevents smothering and quenching of the solid fuels during burning while providing improved performance, such as, amongst others, reducing air borne pollutants.

2. Background Description

Residential and commercial solid fuel combustion in the United States and around the world increased sharply after the oil embargoes of the 1970s. This was partly due to the decrease in oil and gas supplies at that time making it quite difficult to obtain these fuels and the simultaneous extreme price increases in such fuels. However, with the steady increase of residential and commercial solid fuel combustion came a steady increase in environmental pollutants, such as copious amounts of particulate matter. This increase in environmental pollutants was especially true with the increased usage of residential coal and wood burning combustion systems (e.g., wood burning stoves).

Due to the increase in environmental pollutants, states began to regulate wood burning stove emissions. Moreover, the United States Environmental Protection Agency (EPA) also began to regulate the emissions of wood burning stoves, and in 1988 all newly built wood burning stoves had to comply with strict EPA regulations. The EPA regulations require airtight wood burning stoves sold after 1988 to pass an emissions certification test where dimensional lumber (e.g., two by fours and four by fours) with enforced 1.5 inch spacing is burned and particulate matter (PM) emissions are measured. Once a wood burning stove passes the EPA standards, it is certified and allowed to be sold within the United States.

However, after many years of field measurements, the field performance of the EPA certified wood burning stoves leaves much room for improvement. Consumer misuse and/or inattention to proper operation, physical degradation of critical components and lack of maintenance, amongst other reasons, cause emissions to be greater than they need be. The poor field performance of many wood burning stoves is further attributed to the fact that the wood burning stoves are designed to burn clean when burning the wood of the certification test, but are generally not as effective when burning cordwood or other solid fuels at a wider range of moisture contents.

SUMMARY OF THE INVENTION

It is therefore an object of the present invention to provide a combustion system that reduces emissions of air borne pollutants and other organic volatiles relative to emissions from current systems.

It is a further object of the present invention to prevent quenching of the burning fuel in the combustion system.

It is still a further object of the present invention to prevent smothering of the burning fuel in the combustion system.

It is also a further object of the present invention to provide a tuned air delivery in order to properly maintain air/fuel mixtures during burning of solid fuel in the combustion system.

It is another object of the present invention to provide an automatic air control system in the combustion system to improve rekindling of loaded fuel and thereby reduce air borne pollutants and other organic volatiles from discharging from the combustion system after stove reloading.

It is also another object of the present invention to provide an improved loading door that prevents smoke spillage and reduces cool air flow during solid fuel reloading in the combustion chamber.

It is yet another object of the present invention to provide an improved loading door that maintains proper air/fuel ratios within the combustion system during refueling.

It is still another object of the present invention to provide a combustion system that outperforms the EPA certification limit during field operations.

The present invention provides a combustion system comprising a primary combustion chamber divided into left and right sides by fuel-retaining standards. The fuel-retaining standards retain the solid fuel on either side of the primary combustion chamber and define a canyon (or void/space) that serves as or extends into a secondary combustion chamber, in preferred embodiments. The fuel-retaining standards create an unimpeded flow path for combustion gases from the primary combustion chamber to the secondary combustion chamber, while at the same time retaining the solid fuel on either side of the fuel-retaining standards. Thus, the canyon permits flames to travel unimpeded from the bottom of the primary combustion chamber to the top of the secondary combustion chamber.

An air delivery system generally depicted as a lower air tube is positioned within the canyon and preferably at the lower portion of the fuel-retaining standards. The lower air tube provides primary and secondary flows, where the primary flow is ejected through holes which are positioned to directly contact the solid fuel on either side of the fuel-retaining standards. The lower air tube also supplies a lower velocity secondary air ejected from holes and enables secondary combustion of the flaming combustion gases and CO produced by the primary air. In order to supply a lower velocity secondary air flow, a diffuser is provided proximate to the lower air tube which slows and redirects high velocity air ejected from the holes and causes the slower air to stay mainly within and near the canyon, rather than boring into the solid fuel where it would increase the gasification rate of the solid fuel. The air delivery system may also comprise an upper air tube which is located at the upper portion of the fuel-retaining standards and canyon, and within the secondary combustion chamber. The upper air tube provides additional secondary air and cools the catalyst so that it does not overheat and is regulated by an automatic shutter mechanism which senses temperature above or below the catalyst. Additional air delivery tubes may be located in the canyon to deliver additional primary and/or secondary air to the combustion system. A plenum is also provided which substantially eliminates back puffing.

The secondary combustion chamber includes fuel protecting baffles and a secondary combustion chamber ceiling which includes one or more openings and may extend partially over the entire length of the secondary combustion chamber. The fuel protecting baffles divide the primary combustion chamber from the secondary combustion chamber and further provide a passageway so that the canyon gases may enter into the secondary combustion chamber. The upper air tube may be centered above the opening and the canyon so that the flames and combustion gases split upon entering the secondary combustion chamber and go right and left upon reaching the upper air tube.

A loading door is positioned at the front of the combustion system so that solid fuel, such as wood, can be loaded into the primary combustion chamber. The loading door comprises a hollow frame and a window mounted in the hollow frame. The loading door further comprises holes which draw air into the hollow frame and direct the air into the primary combustion chamber.

A bypass system prevents the loading door of the combustion system from being fully closed unless the bypass is in the completely closed position. An automatic air setting mechanism is provided so that an initial higher air setting is maintained until the solid fuel becomes fully involved in the combustion process.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

For illustrative purposes only a wood burning stove will be described. However, it is well understood that the combustion system of the present invention can be a coal burning stove or any other combustion system that uses solid fuels, either industrially or commercially or residentially. It is further understood that the dimensions of the combustion system, including length, width, shape and other variables and quantities specified herein may vary with the type of system contemplated. Therefore, numbers and dimensions specified herein are not to be construed as limitations on the scope of the present invention, but are meant to be merely illustrative of one particular application of the present invention.

THE COMBUSTION SYSTEM

Figure 1:
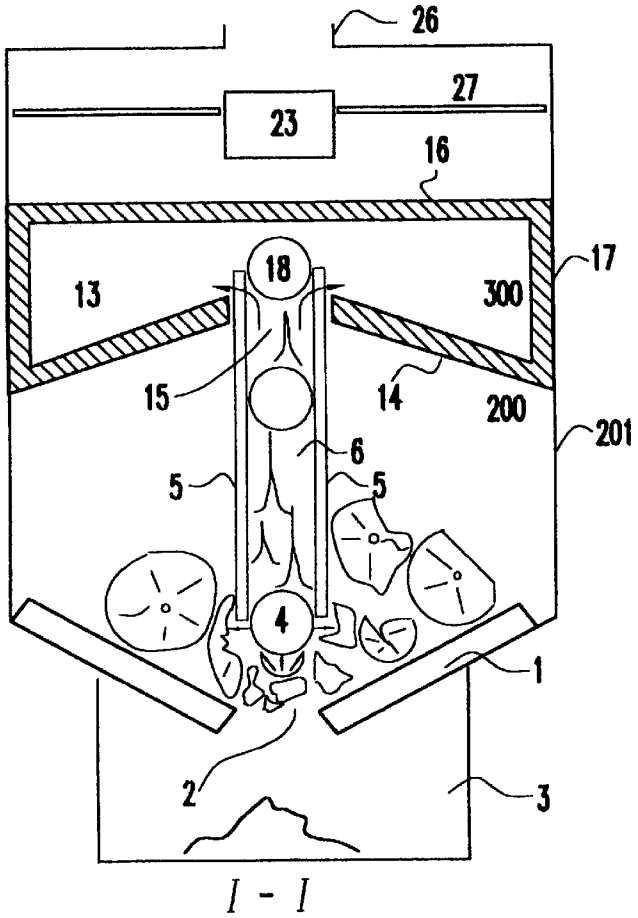
FIG. 1 is front sectional view of the combustion system of the present invention.

Referring now to the drawings, and more particularly to FIG. 1, there is shown a front sectional view of the combustion system comprising a primary combustion chamber 200 and a secondary combustion chamber 300 located substantially above the primary combustion chamber 200. In preferred embodiments, the primary combustion chamber 200 is defined by front, rear and side walls 201, a firebox floor 1, and fuel protecting baffles 14.

In further preferred embodiments, the firebox floor 1 is V-shaped so that solid fuel can be directed towards the center of the primary combustion chamber 200 as the fuel is consumed. However, the firebox floor 1 may be a sloped, slanted or flat surface depending on the particular use of the present invention. For example, in one such embodiment, the firebox floor 1 comprises a substantially sloped downward surface starting from the side walls and continuing to a center portion where the floor begins to flatten into a flat surface. In embodiments, the firebox floor 1 includes a gap 2 so that ash can pass into an ash chamber 3 positioned below the firebox floor 1 and allow air to rise or fall through the combustion system.

Fuel-Retaining Standards

As further seen in FIG. 1, the primary combustion chamber 200 is divided into left and right sides by fuel-retaining standards 5. In preferred embodiments, the fuel-retaining standards 5 are rods; however screens, tubes, solid panels, or any other cross sections with various heat transmission capabilities which separate the primary combustion chamber 200 into two regions are contemplated for use by the present invention. It is further understood that the left and right sides may equally be depicted as front and rear sides of the primary combustion chamber 200. Alternatively, one side (e.g., left, right, front or back) of the combustion system may be bordered by the canyon ( FIG. 2).

The primary purpose of the fuel-retaining standards 5 is to retain the solid fuel (e.g., wood) on either side of the primary combustion chamber 200 and to create a canyon 6 that extends into the secondary combustion chamber 300. In preferred embodiments, the firebox floor 1 and the fuel-retaining standards 5 direct the burning solid fuel toward a primary air tube and the lower portion of the canyon 6, while at the same time retaining the non-burning solid fuel on a side of the fuel-retaining standards 5. This prevents quenching and smothering of the burning solid fuel because it does not allow cooler non-burning solid fuel to impede the upward flow of the combustion gases within the canyon 6.

To this end, the canyon 6 permits flames to travel unimpeded from the bottom of the primary combustion chamber 200 to the top of the secondary combustion chamber 300, thereby more efficiently burning the solid fuel. The fuel-retaining standards 5 may also deliver combustion gases from the bottom of primary combustion chamber 200 of the secondary combustion chamber 300. In embodiments, the fuel-retaining standards 5 may be air cooled and deliver air to different regions of the primary combustion chamber 200 and/or secondary combustion chamber 300.

In embodiments, the fuel-retaining standards 5 can lean in several directions, for example, outward, inward, or alternatively, vertically, with respect to the side walls 201 of the primary combustion chamber 200. When the fuel-retaining standards 5 lean outward, the solid fuel within the primary combustion chamber 200 tends to settle consistently with less chance of bridging or hanging up within the primary combustion chamber 200.

Air Delivery System

Remaining with FIG. 1, an air delivery system generally depicted as a lower air tube 4 is positioned within the canyon 6 and preferably at the lower portion of the fuel-retaining standards 5. The air delivery system may also comprise an upper air tube 18 which is located at the upper portion of the fuel-retaining standards 5 (and canyon 6) and within the secondary combustion chamber 300. In preferred embodiments, the lower air tube 4 is positioned above and along the side of the burning fuel (e.g., wood or coal).

Additional air delivery tubes are further contemplated for use by the present invention and may be located in the canyon 6 to deliver additional primary and/or secondary air to the combustion system. An advantage of separate primary and secondary air tubes is that the amounts and locations and relative proportions of primary and secondary air can be independently varied while the nature of the combustion process changes due to increased charcoalization of fresh solid fuel.

Catalyst Over Temperature Control

In addition to providing air/fuel ratio control (as described below), the air provided by upper air tube 18 also cools the catalyst 23 so that it does not overheat (when the catalyst 23 is operated even briefly at overly high temperatures the catalytic activity rapidly and permanently decreases). To prevent overheating of the catalyst 23, a shutter 20 controls and regulates air flow passing through the upper air tube 18. The shutter 20 is controlled by a bimetallic coil 21 attached to a mounting rod 22 that protrudes above the catalyst 23. The bimetallic coil 21, the mounting rod 22, and the shutter 20 are kinematically and thermally designed to open the shutter 20 very rapidly as post-catalyst temperature exceeds about 600 degrees C. Also, to further control and distribute the air flow through the upper tube 18, the upper tube 18 may include various size holes 19 and diameters.

However, for some combustion system designs, separate bimetallic coils may be provided. In these cases, a first bimetallic coil senses pre-catalyst temperature and controls air/fuel ratio to avoid overly fuel-rich operation, and a second bimetallic coil senses post-catalyst temperature and controls air/fuel ratio to prevent catalyst over temperature. If two bimetallic coils are necessary, each coil may operate separate shutters or may be linked to the same shutter, depending on the specific use of the combustion system.

In embodiments, the bimetallic coils may be replaced by thermocouples and a control unit and actuators which are electronically controlled by a control system of the present invention.

Accordingly, over temperature protection system of the present invention is highly effective because it adds dilution air to the combustion products without adding air to the primary combustion chamber, where more air could increase the burn rate and cause catalyst temperatures to increase.

Sectional View of Alternate Primary Combustion Chamber

Figure 2:
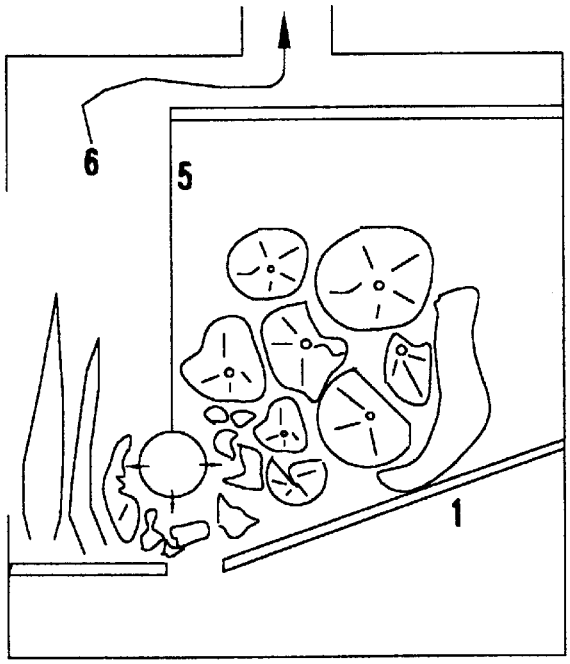
FIG. 2 is a side view of an alternate embodiment showing two firebox sections, fuel retained by standards and canyon left of the fuel.

FIG. 2 shows the fuel-retaining standards 5 preventing the solid fuel from entering the canyon 6, while the flame and combustion gases remain within the canyon 6. Also, FIG. 2 shows a sloped firebox floor 1 guiding the solid fuel into the canyon 6. In this embodiment, the combustion chamber is divided into two regions, the left region effectively being the canyon.

The Secondary Combustion Chamber

The secondary combustion chamber 300 is defined by fuel protecting baffles 14, secondary combustion chamber walls 17 and a secondary combustion chamber ceiling 16. The secondary combustion chamber walls 17 are preferably made of insulating material such as refractory fiberboard.

In preferred embodiments, the secondary combustion chamber ceiling 16 extends partially over the length of the secondary combustion chamber 300 so that combustion gases and other organic material may contact the catalyst 23. Alternatively, the secondary combustion chamber ceiling 16 includes one or more openings so that the combustion gases and other organic material may flow into the space above the secondary combustion chamber ceiling 16 and again contact the catalyst 23.

In the embodiment shown, the secondary combustion chamber ceiling 16 extends to the side and rear secondary combustion chamber walls 17, and stops short of the front secondary combustion chamber walls 17. An alternative arrangement is for secondary combustion chamber ceiling 16 to extend to the front and side secondary combustion chamber walls 17, but to stop short of the rear secondary combustion chamber walls 17. For illustrative purposes only, the secondary combustion chamber 300 has vertical side secondary combustion chamber walls 17, but curved walls which smooth the combustion gases flow at the sides of the secondary combustion chamber 300 are also contemplated for use by the present invention.

In preferred embodiments, the fuel protecting baffles 14 divide the primary combustion chamber 200 from the secondary combustion chamber 300 and further provide a passageway 15 (e.g., opening) so that flames and gases from the canyon 6 may enter the secondary combustion chamber 300. The fuel protecting baffles 14 are preferably metal and/or insulating material and further force the combustion gases to leave the primary combustion chamber 200, via the canyon 6 and opening 15 created by the inner edges of protecting baffles 14.

In embodiments, the opening 15 is rectangular and the fuel protecting baffles 14 slope upward toward the center of the combustion system. Because of the upward slope of the protecting baffles 14, if flaming occurs between the solid fuel and the fuel protecting baffles 14, buoyancy will move the flames and the combustion gases toward the opening 15 and away from the burning solid fuel, thus reducing the gasification rate of the fuel near the fuel protecting baffles 14. Depending on the design of the standards 5 and the overall size of the combustion system, more or less gasification of the fuel near the protecting baffles 14 may be desirable, and both the angle and conductivity of the fuel protecting baffles 14 may be chosen to achieve optimal conditions. The fuel protecting baffles 14 also prevent combustion gases from reentering the primary combustion chamber 200.

In embodiments, the secondary combustion chamber 300 includes holes in the secondary combustion chamber ceiling 16 or the secondary combustion chamber walls 17. These holes allow air to enter the secondary combustion chamber 300 so that combustible gases such as CO and hydrocarbons can be efficiently eliminated.

In preferred embodiments, the upper air tube 18 is centered above the opening 15 and canyon 6 so that the flames and combustion gases split upon entering the secondary combustion chamber and go right and left upon reaching the upper air tube 18. Further, the air ejected from the upper air tube 18 flows in the same direction as the secondary combustion chamber gases and enhances mixing of the combustion gases and the air. Additional mixing may also take place due to the creation of vortices above the upper air tube 18 (FIG. 5) and in the comers of the secondary combustion chamber 300.

Fuel/Air Ratio Control

Figure 3:
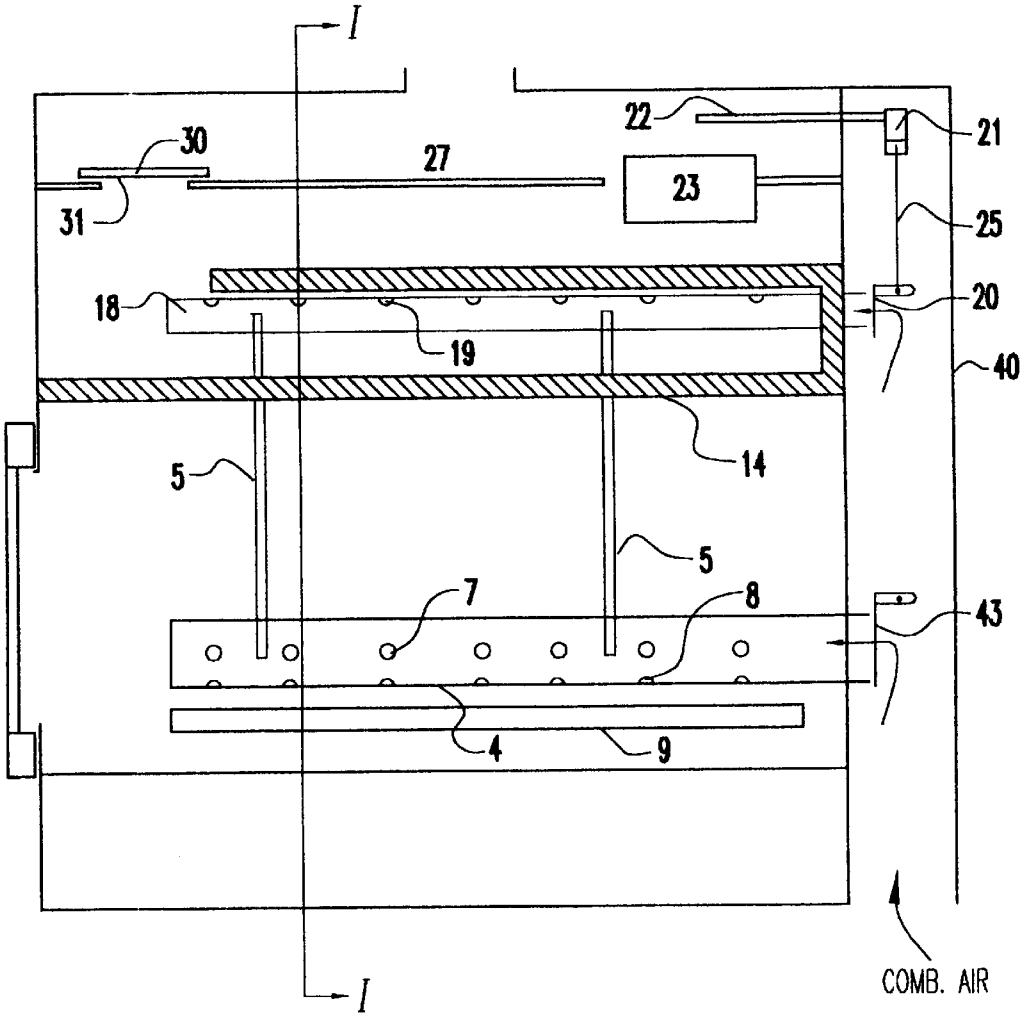
FIG. 3 is a side sectional view of the combustion system of the present invention.

Referring now to FIG. 3, a side sectional view of the combustion system is shown. FIG. 3 shows both the lower air tube 4 and the upper air tube 18 containing holes or apertures in order to supply combustion air. By supplying air through the lower air tube 4 and the upper air tube 18, a proper air/fuel ratio is maintained during burning of the solid fuel within the canyon 6. Further, in embodiments, the lower air tube 4 provides air streams with various purposes depending on primary combustion chamber 200 size, fuel properties, and intended performance of the combustion system.

In preferred embodiments, the lower air tube 4 provides primary and secondary flows, where the primary flow is ejected through holes 7 which are positioned to directly contact the solid fuel on either side of the fuel-retaining standards 5. This promotes the formation of both CO and volatile organics from the settling solid fuel (e.g., wood or coal). The lower air tube 4 also supplies lower velocity secondary air ejected from holes 8. The lower velocity secondary air enables secondary combustion of the flaming combustion gases and CO produced by the primary air ejected from holes 7 and/or other air supplies.

In order to supply a lower velocity secondary air flow, a diffuser 9 supported from the lower air tube 4 is provided. The diffuser 9 redirects high velocity air ejected from the holes 8, and thus provides low velocity air. The diffuser 9 also directs the low velocity air to stay mainly within and near the canyon 6, rather than boring into the solid fuel where it would increase the gasification rate of the solid fuel.

Active fuel/air ratio control is achieved by varying the amount of air delivered by the upper air tube 18 through holes 19. This is accomplished by sensing the temperature of the gases downstream of the secondary combustion chamber 300 and varying the position of a shutter 20 to regulate the flow of air into the upper air tube 18. In one embodiment, the shutter 20 is controlled by a bimetallic coil 21 attached to a mounting rod 22 that protrudes above the catalyst 23. In an alternative embodiment, the rod 22 and the bimetallic coil 21 are located below the catalyst 23. The rod 22 acts as a fin and transmits heat to the bimetallic coil 21 which senses gas temperature downstream of the catalyst 23. Although the relationship between temperature and fuel/air ratio is complicated by the thermal mass of the combustion system and the amount of chemical reaction occurring in the catalyst 23, the correlation between temperature and fuel/air ratios is good enough for fuel/air ratio control in this system.

When the gas temperature is high enough to indicate that there is little excess oxygen in the gas stream, bimetallic coil 21 takes up the slack in linkage rod 25 and shutter 20 begins to open. The opening rate is fast enough to prevent fuel-rich operation which causes increased emissions and reduced efficiency. For non-catalytic combustion systems, the sensor is preferably located to sense the temperature of gases leaving the secondary combustion region.

Plenum

During the operation of a solid fuel combustion system, mixtures of air and fuel gases within the combustion system can accumulate and ignite to produce back puffing. This back puffing causes smoke to be emitted into the living space around the combustion system, via the air inlets.

Referring to FIG. 3, a plenum 40 which substantially eliminates the smoke emissions from back puffing is provided. The plenum 40 is provided at an end of both the upper air tube 18 and the lower air tube 4. In preferred embodiments, the upper air tube 18 and the lower air tube 4 are ducted so they draw air from near the top of the plenum 40. In further embodiments, the plenum 40 is opened at the bottom and is sealed to the combustion system along its side and top edges and includes a width approximately the same size as that of the combustion system and a volume that accommodates the smoke resulting from back puffing. When back puffing does occur, the smoke accumulates in the plenum 40 and is drawn back into the combustion system through both or either of the air tubes 4 and 18. The plenum 40 also preheats the incoming air and allows reduced clearances between the rear of the combustion system and combustible materials.

FIG. 3 additionally shows a shutter 43 that regulates air flowing through the lower air tube 4 and a bypass system 27, 30, 31. The bypass system works in conjunction with a loading door so that when the loading door is in the open position, combustion gases and other organic materials can bypass the catalyst 23 so that smoke or other pollutants are not released into the indoors.

Gas Flow Paths

FIGS. 4–8 show the combustion gases flow path within several areas of the combustion system.

General Gas Flow Path

Figure 4:
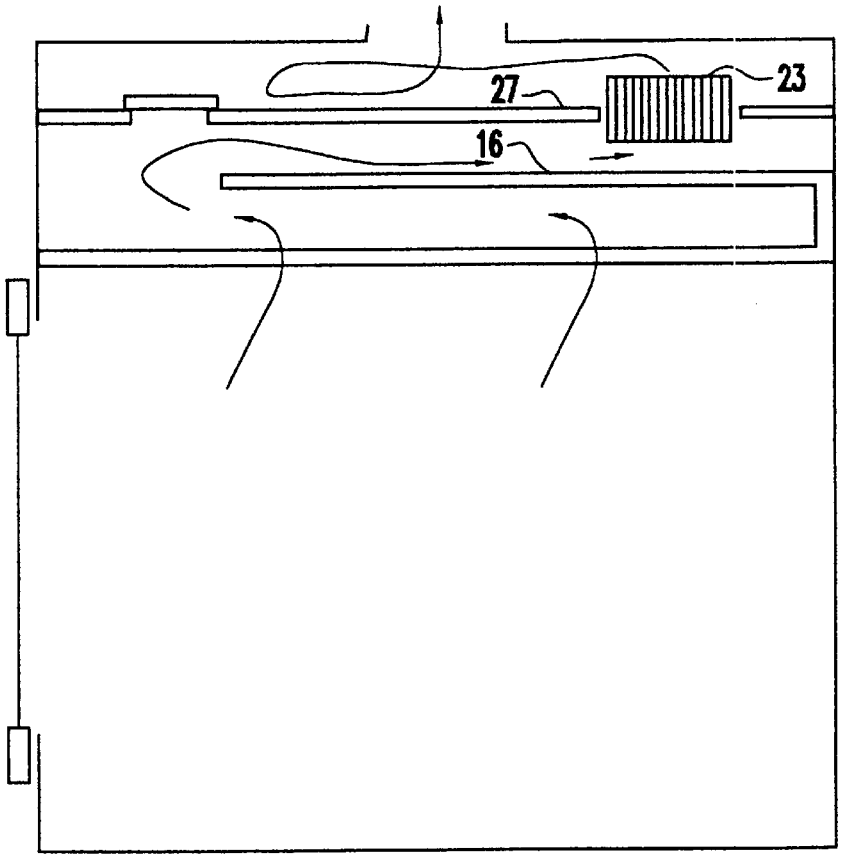
FIG. 4 is a flow pattern of combustion gases of the present invention.

FIG. 4 shows the general flow of combustion gases after they leave the primary combustion chamber 200 and enter into the secondary combustion chamber 300. Specifically, the combustion gases flow into the secondary combustion chamber 300 and around the front edge of the secondary combustion chamber ceiling 16 towards the catalyst 23. After flowing through the catalyst 23, the combustion gases, now devoid of most of the particulate matter and other organic pollutants, flow through the flue 26 of the combustion system.

Gas Flow Within the Secondary Chamber

Figure 5:
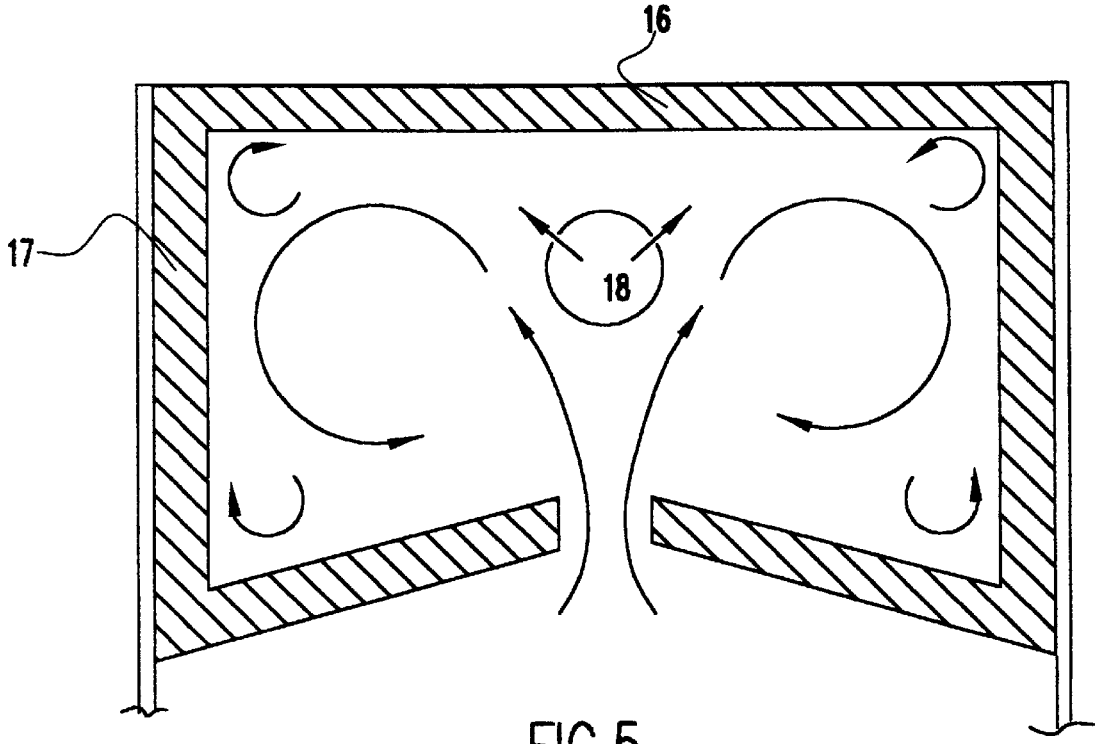
FIG. 5 is a front view of the flow pattern of combustion gases in the secondary combustion chamber of the present invention.

FIG. 5 is a front view of a flow pattern of the combustion gases in the secondary combustion chamber 300. The combustion gases leave the primary combustion chamber 200 via the canyon 6 and enter the secondary combustion chamber 300 and split into right and left side vortexes by the upper air tube 18. Air and combustion products leaving the left side of the upper air tube 18 create a counterclockwise vortex near the left secondary combustion chamber wall 17 and small clockwise vortices along the upper and lower edges of the left secondary combustion chamber wall 17. A symmetrical flow field occurs on the right side of the secondary combustion chamber 300. The rotating gases at both secondary combustion chamber walls 17 are drawn toward the front of the combustion system and exit the secondary combustion chamber 300 by passing around the front edge or other openings of the of secondary combustion chamber ceiling 16.

When the fuel protecting baffles 14 are sloped upward toward the combustion system center, they prevent cooler secondary combustion chamber gases (rich in oxygen) from dropping through the opening 15 into the primary combustion chamber 200 where the cooler secondary combustion chamber gases would increase the burn rate beyond that which results from air delivered by the lower air tube 4 and other passages (e.g., window air passages 12) which are intended to feed into the primary combustion chamber 200.

Catalytic Gas Flow Path

Figure 7:
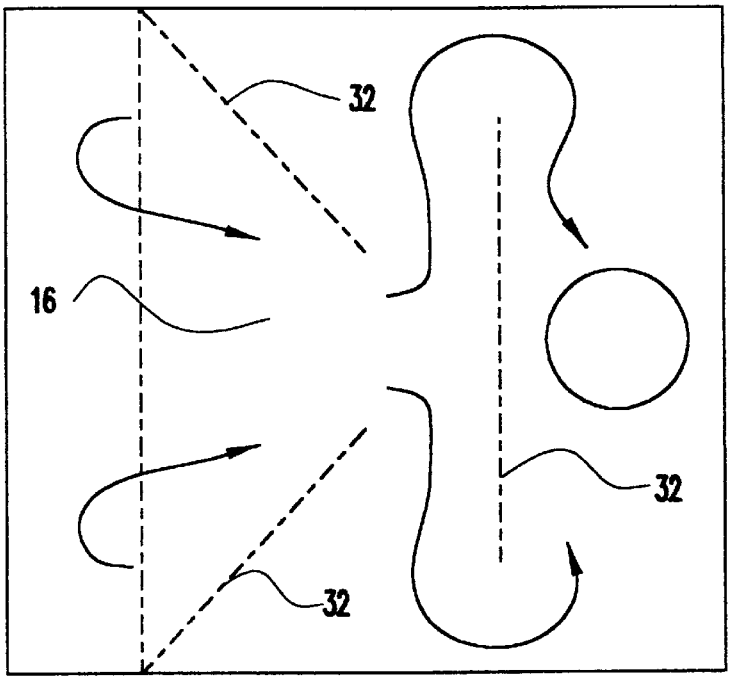
FIG. 7 is a top view of the flow pattern of the combustion gases approaching the catalyst.

FIG. 7 is a top view of the flow pattern above the secondary combustion chamber 300 when the secondary combustion chamber gases flow over the secondary combustion chamber ceiling 16 and toward the catalyst 23. The secondary combustion chamber gases then flow by mixing baffles 32, where the flow is turned 90 degrees toward the sides of the combustion system, and then turned 180 degrees to flow toward the catalyst 23.

Figure 6:
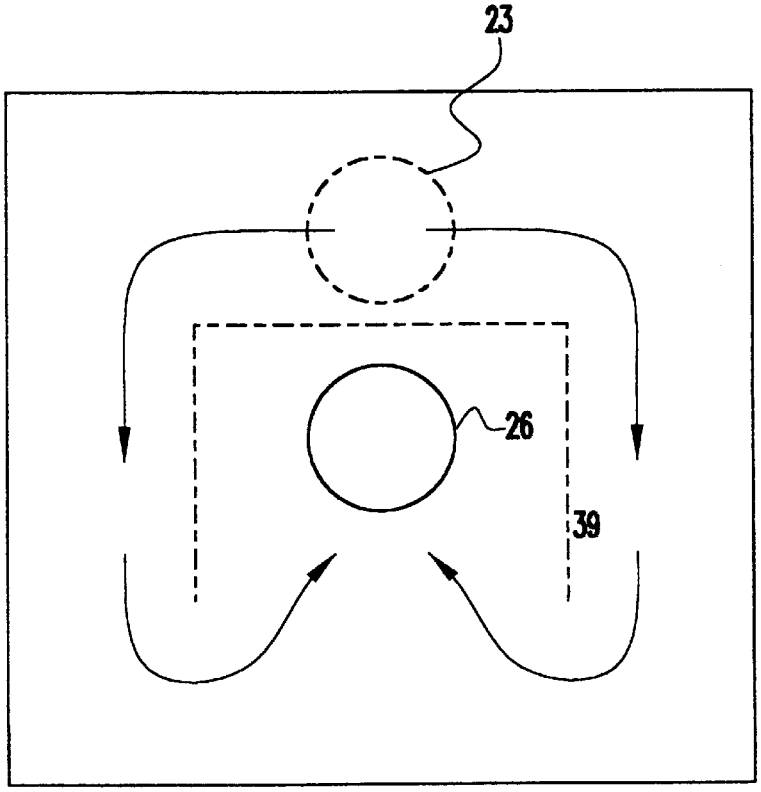
FIG. 6 is a top view of the flow pattern of combustion gases leaving a catalyst.

FIG. 6 shows a top view of a flow pattern of the combustion gases leaving the catalyst 23 . The flow pattern shown in FIG. 6 utilizes the heat transfer surface of the top of the combustion system.

As seen in FIG. 6, the catalyzed gases flow sideways, turn 90 degrees to flow toward the front of the combustion system, and then turn 180 degrees to flow toward the flue 26. In the absence of the post-catalyst baffles 39, the flow of the combustion gases would "short circuit" from the catalyst outlet to the flue 26 without taking advantage of the heat transfer surface created by the top of the combustion system.

Non-Catalyst Gas Flow

Figure 8:
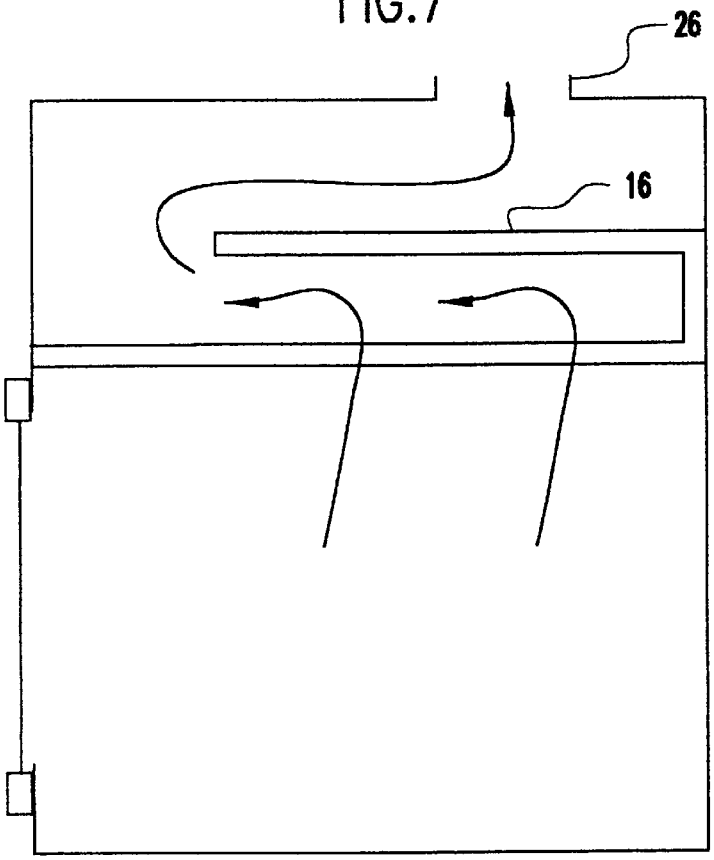
FIG. 8 is a side view of the flow pattern of a non-catalytic version of the combustion system.

FIG. 8 shows a side view of a non-catalytic flow pattern of combustion gases where the secondary combustion chamber gases flow directly from the secondary combustion chamber 300 over the secondary combustion chamber ceiling 16 and through the flue 26.

Diffuser Design

Figure 9A:
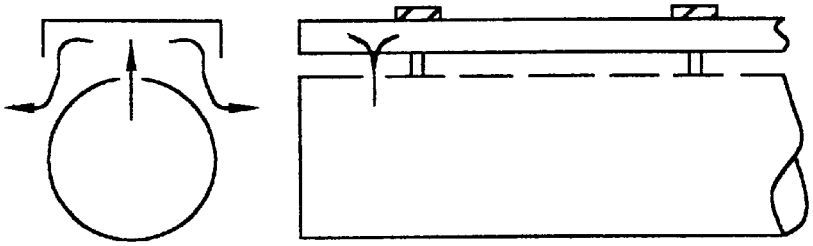
FIGS. 9*a*–9*g* show several diffuser structures used in the combustion system of the present invention.
Figure 9B:
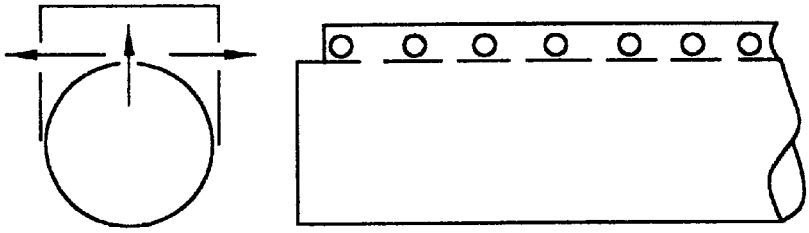
Figure 9C:
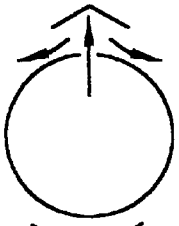
Figure 9D:
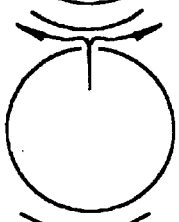
Figure 9E:
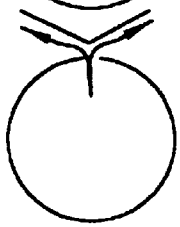
Figure 9F:
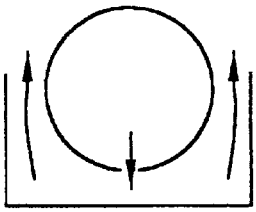
Figure 9G:
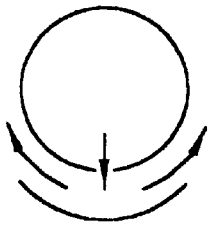

FIGS. 9*a*–9*g* show several alternative diffuser 9 designs, some of which give upward and some of which give downward velocity components to the lower velocity air flow of the lower air tube 4. Referring to FIGS. 9*a*–9*e*, several baffle designs are shown where the baffles 9 area located at an upper portion of the lower air tube 4 close to or, preferably, within the canyon 6. FIGS. 9*f* and 9*g* show the baffle 9 on the underside of the air tube 4 closest to the ash pile. In embodiments 9*a*–9*e*, the diffuser 9 serves as a shield to prevent ash from clogging the secondary air delivery holes 8. In FIG. 1, the diffuser design of FIG. 9*g* is shown.

In preferred embodiments, the holes 8 are smaller in cross sectional area than the flow area available between the baffle 9 and the lower air tube 4. This configuration lowers the velocity of the air exiting through the hole 8 in order to provide the lower velocity secondary air source. The size and number of holes 7 and holes 8 determine the relative amounts of primary and secondary air released by the lower air tube 4.

Air-Cooled Loading Door

Figure 10:
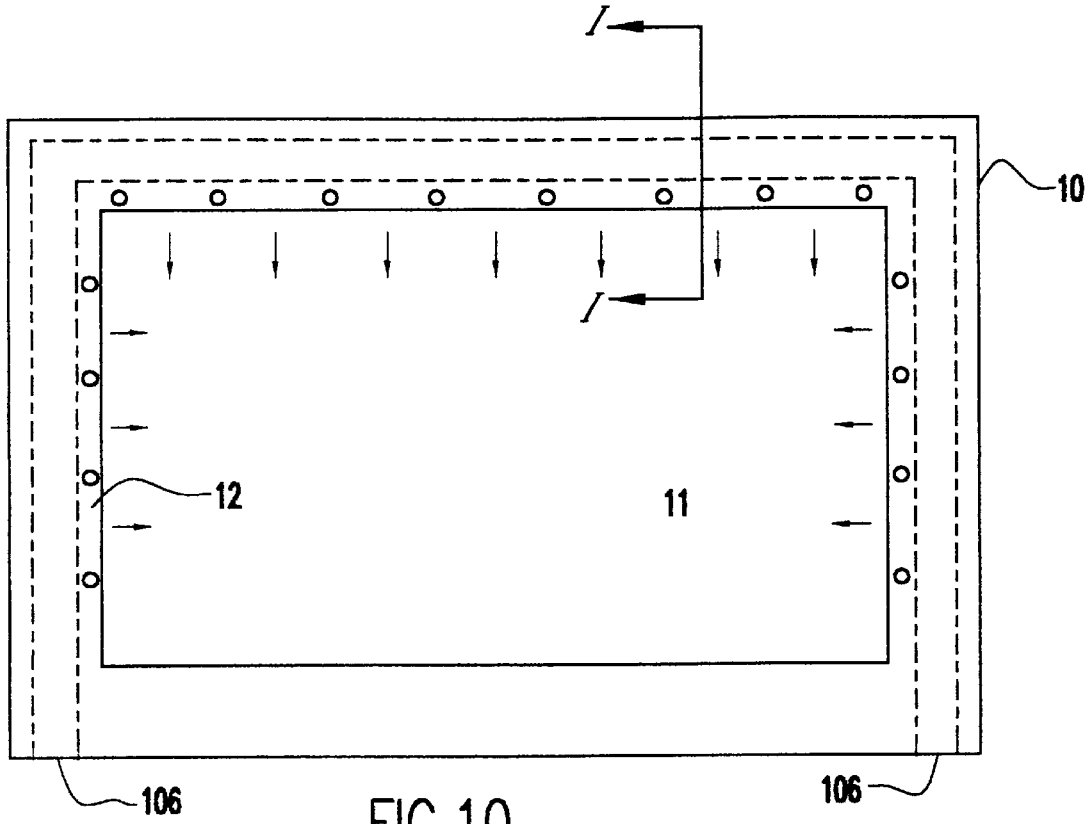
FIG. 10 is a loading door of the combustion system of the present invention.

FIG. 10 shows a loading door of the combustion system. In preferred embodiments, the loading door is positioned at the front of the combustion system so that solid fuel, such as wood, can be loaded into the primary combustion chamber 200.

In embodiments, the loading door comprises a hollow frame 10 and a window 11 mounted in the hollow frame 10. In preferred embodiments, the loading door is preferably positioned so that the window 11 is positioned perpendicular to the lower air tube 4 such that the solid fuel is placed on either side of the fuel-retaining standards 5 (FIGS. 1 and 2).

The loading door further comprises air inlet holes 10*b* located preferably at the bottom of the loading door. However, the holes 10*b* can be located at any position on the hollow frame 10. The holes 10*b* draw air into the hollow frame 10 which directs the air approximately parallel to the firebox-facing side of the window 11 and into the primary combustion chamber 200. Thus, air flow reduces the accumulation of the condensed materials that would block the light produced by flames in the primary combustion chamber 200. The holes 10*b* in conjunction with the lower air tube control system also provide another means to adjust the primary combustion chamber 200 air/fuel ratio. FIG. 10 further shows passages 12 metering and directing air from the top and side edges of the window 11.

Figure 11:
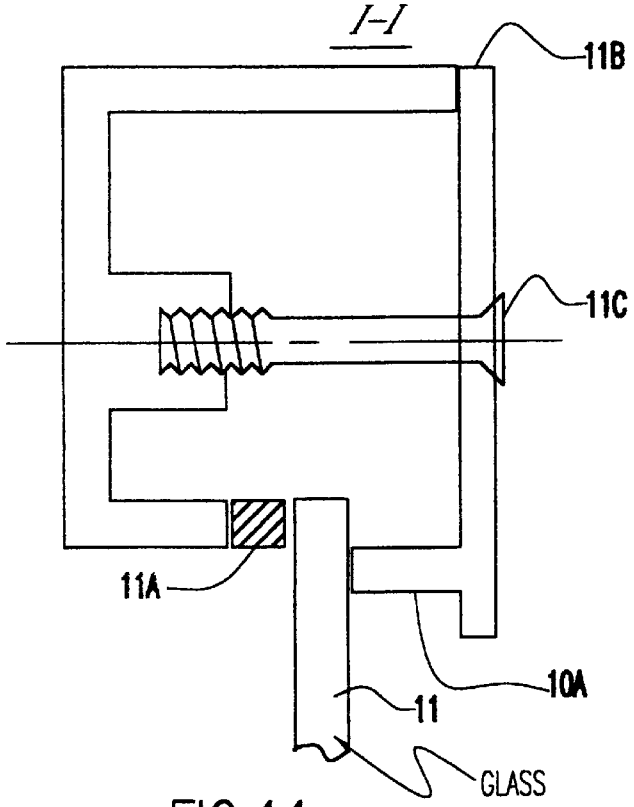
FIG. 11 is a sectional view of the loading door along line A—A of FIG. 10.

FIG. 11 shows a sectional view of the loading door along line A—A of FIG. 10. Specifically, the hollow frame 11 comprises a retaining plate 11*b* which forms a rear surface of the hollow frame 10 and extends past the edge of window 11. The frame 10 may be extruded or cast. A gasket 11*a* runs along the out-facing side of the window 11 and bolts 11*c* hold the retaining plate 11*b* and the window 11 to the hollow frame 10. High spots or protrusions 10*a* are provided on the retaining plate 11*b* in order to hold the window 11 at a defined distance from the retaining plate 11*b* so that the air may pass through the passages 12 between the high spots 10*a* of retaining plate 11*b* and the window 11.

The natural dimensional stability of the window 11 and the minimal thermal expansion of the air cooled hollow frame 10 combine to give an inexpensive and reliable method to produce fixed geometry passages 12 that control the air flow. The air-cooled nature of the loading door reduces the temperatures to which the window and door gaskets are exposed to and therefore allows a broader choice of gasket material, for example, silicone rubber. In embodiments, the passages 12 also provide another means for controlling the air/fuel ratio and burn rate within the combustion system. Further, the lower air tubes 4 can also supply air to the hollow door frame 10 in order to control the air/fuel ratio of the combustion system.

The Bypass System

Poor catalytic performance results from the improper use of the bypass system. That is, many operators fail to properly adjust the bypass when the loading door is either in the open or closed position. Typically, the improper use of the bypass allows combustible gases to bypass the catalyst or smoke spillage to occur when the loading door is opened. In either case, high pollutant emissions result from such misuse of the bypass system.

Figure 12:
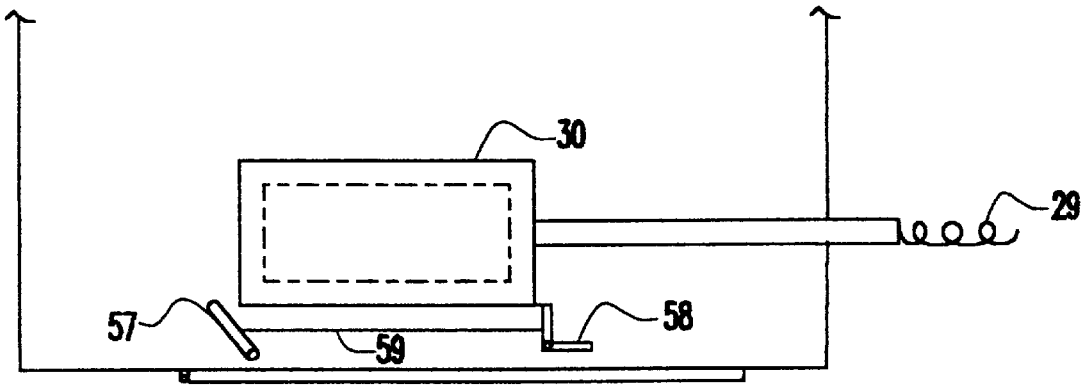
FIG. 12 is a bypass system of the combustion system of the present invention when the loading door is closed.
Figure 13:
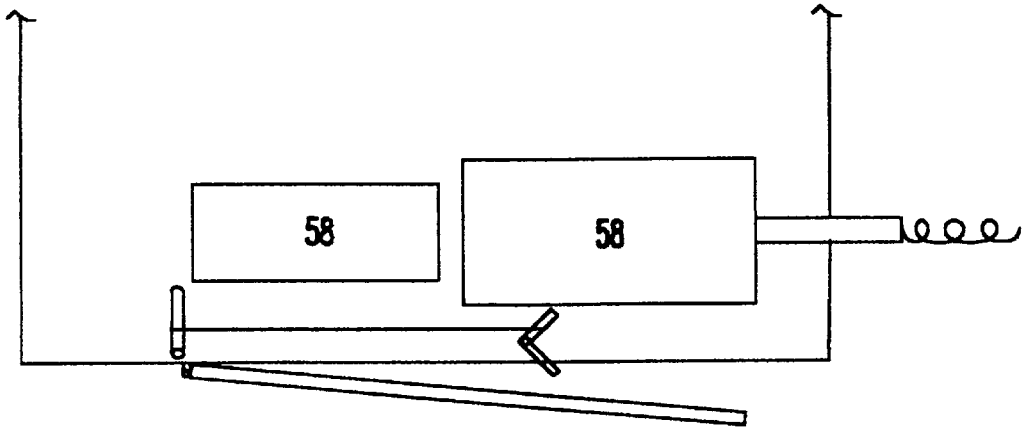
FIG. 13 is the bypass system of the combustion system of the present invention when the loading door is open.

FIGS. 12 and 13 show a bypass system that prevents the loading door of the combustion system from being fully closed unless the bypass hole 31 is completely covered by bypass plate 30. FIG. 12 shows a closed bypass hole 31, where bypass plate 30 is positioned over the bypass hole 31. The bypass plate 30 is connected to a handle 29 for opening and closing the bypass hole 31. In preferred embodiments, the bypass system includes an L-shaped link 58 connected to an I-shaped link 57 via a rod 59.

In the closed position (FIG. 12), the I-shaped link 57 contacts a comer of the bypass plate 30 and the L-shaped link 58 is positioned away from any portion of the bypass plate 30. In this position, one leg of the L-shaped link 58 is positioned adjacent to and substantially parallel with the front wall of the door frame 10 so that it does not interfere with the closing of the loading door. Both the I-shaped link 57 and the L-shaped link 58 are pivotally mounted.

FIG. 13 shows the bypass plate 30 positioned along side the bypass hole 31, when the loading door of the combustion system is in the partially open position. To achieve this situation, the operator partially opens the loading door and then pulls the handle 29 outwards which slides the bypass plate 30 in contact with the L-shaped link 58 so that the horizontal leg of the L-shaped link 58 protrudes from the face of the combustion system. This prevents the loading door from being placed in closed position until the bypass plate 30 is returned to the closed position (FIG. 12). When the bypass plate 31 is returned to the closed position, the corner of the bypass plate 30 contacts and pivots the I-shaped link 57 into an angled position, preferably 45 degrees. The L-shaped link 58 then pivots to its original position so that it no longer protrudes past the face of the combustion system. Thus, the bypass system prevents the loading door from closing when the bypass 30 is in the open position.

Catalyst Mounting

The catalyst 23 of the present invention is a monolithic combustion system catalyst, where the mounting mechanism avoids canning or conventional gasketing which results in a more efficient use of the catalytic surface. ("Canning" refers to the practice of wrapping a thin flexible insulating blanket around the catalyst and holding the blanket close to the catalyst by tightly wrapping and then securing a layer of sheet metal around the blanket. This procedure masks and renders ineffective roughly 50 square inches of catalytic surface.)

Figure 14:
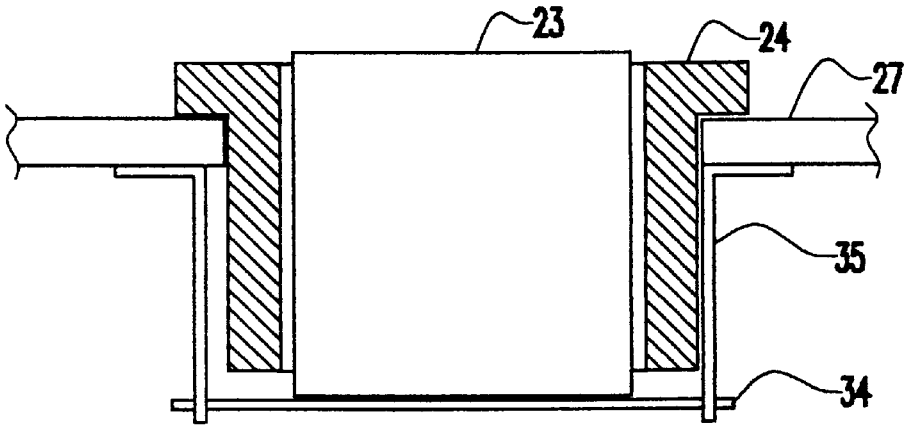
FIG. 14 is a side sectional view of the catalyst mounting system.

FIG. 14 is a side sectional view of the catalyst mounting system showing a round catalyst 23 held by a side support 24 and a bottom support rod 34. In embodiments, the catalyst 23 may be a square, an oval, and the like, depending on the particular use of the present invention. In preferred embodiments, the side support 24 is a low density ceramic fiberboard which insulates the catalyst 23 and helps maintain adequate temperature for catalytic activity. The side support 24 further includes a flange that when fitted into a panel 27 forms a seal around the panel 27. The support rod 34 is fixed to the underside of the panel 27.

Figure 15:
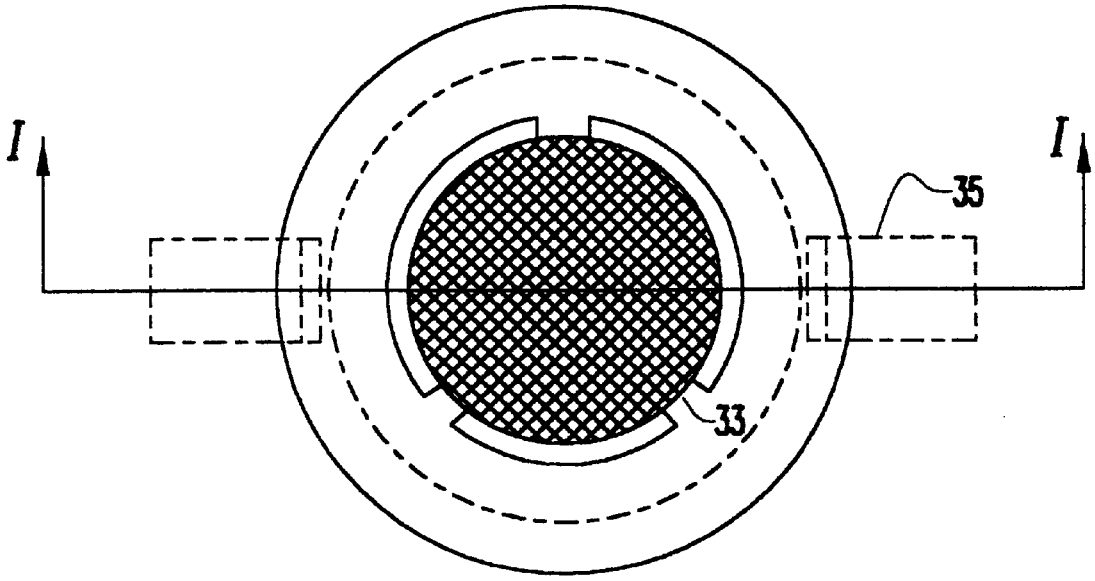
FIG. 15 is a top view of the catalyst mounting system.

FIG. 15 shows a top view of the catalyst mounting system in which protruding ribs 33 center the catalyst 23 within the side support 24. The protruding ribs 33 minimize masking of the catalyst surface and maximize space for the combustion gases to flow parallel to the protruding ribs 33. The masking of the catalyst surface is minimized and the space for the combustion gas flow is maximized by using less protruding ribs 33. The protrusion distance of protruding ribs 33 from the side support 24 is limited by the need to prevent gases between the catalyst 23 and the side support 24 from being too far from the catalytic surface, resulting in less conversion of pollutants. Thus, the mounting mechanism of the present invention increases the effective amount of catalytic surface and reduces the flow resistance.

Figure 16:
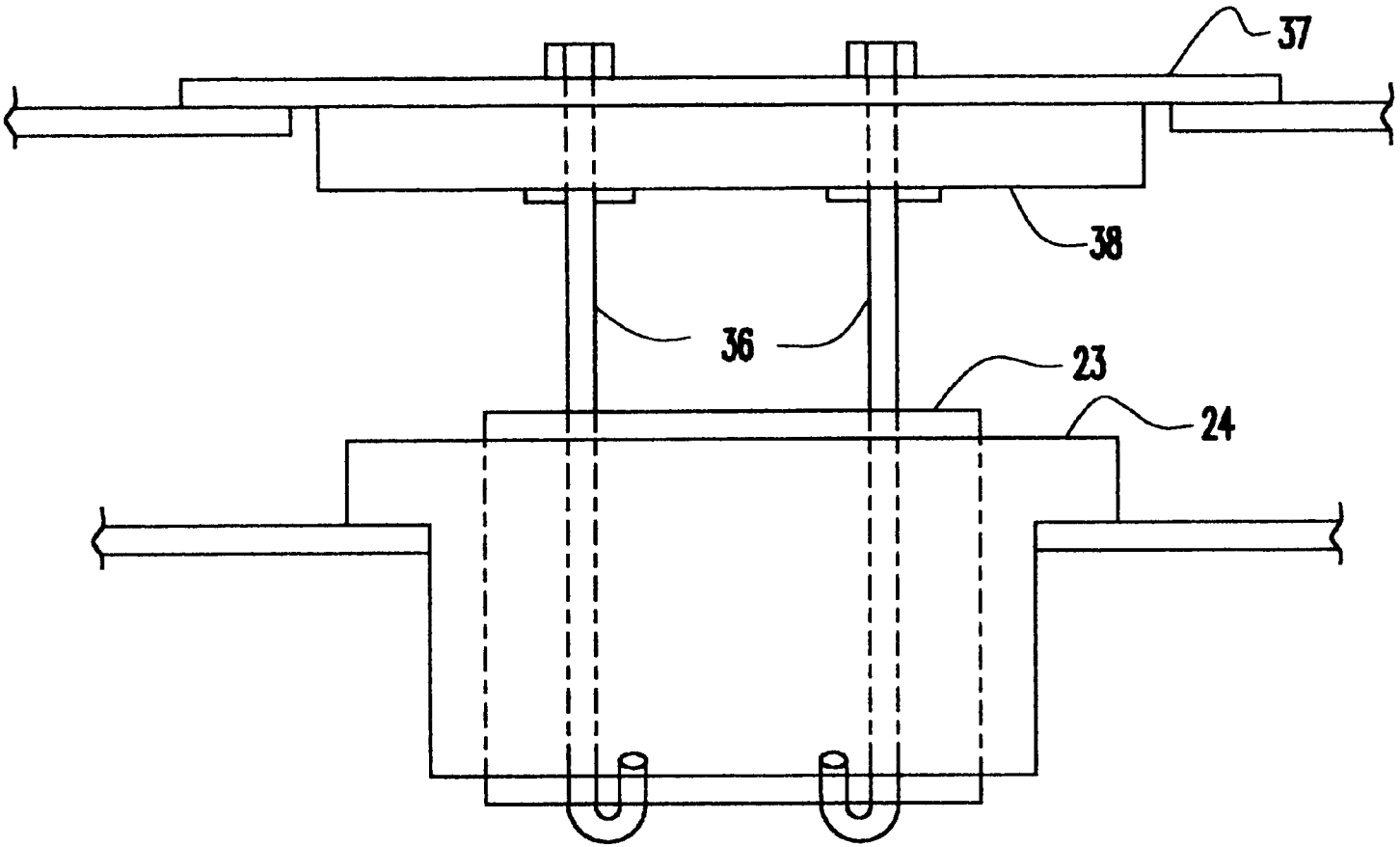
FIG. 16 is a side view of an alternative embodiment of the catalyst mounting system.

FIG. 16 shows an alternate method of mounting the catalyst 23. In this embodiment, one or more rods 36 hook underneath the catalyst 23 and are supported by a catalyst access cover 37 of insulating material or with insulation 38 attached to the underside. The insulated cover 37 reduces radiative and convective heat losses from the top surface of the catalyst 23, and helps the catalyst 23 maintain adequate temperatures for catalytic activity.

By using the side support 24 of FIGS. 13, 14 and 16, canning is not required and additional catalyst surface area is available to catalyze the gases. Also, flow resistance is decreased and the mounting structure does not cause significant mechanical stress to the catalyst 23. Further, the catalyst 23 can be easily removed (for inspection, cleaning, or replacement) without working inside the combustion chamber or unfastening fasteners that are exposed to extreme temperatures and which may be difficult to remove.

Temporary Air Setting for High or Low Fire

In order to maintain efficient and clean combustion system operation during reloading of solid fuels, it is imperative that a high air setting (e.g., air control system) be maintained to prevent quenching and other emission problems. However, it is not uncommon for the operator to improperly adjust and maintain the air settings during the reloading of solid fuels. By not properly adjusting and temporarily maintaining the high air setting, in a case of a catalytic system the catalyst temperature can drop and catalytic activity can cease, resulting in organic materials condensing on the catalyst surface and preventing catalysis until and unless higher temperatures can drive off the condensed organics. In the case of a non-catalytic system, the burn rate drops and the secondary combustion system fails to operate properly. In order to prevent this a catalyst low temperature alarm may be provided.

Figure 17:
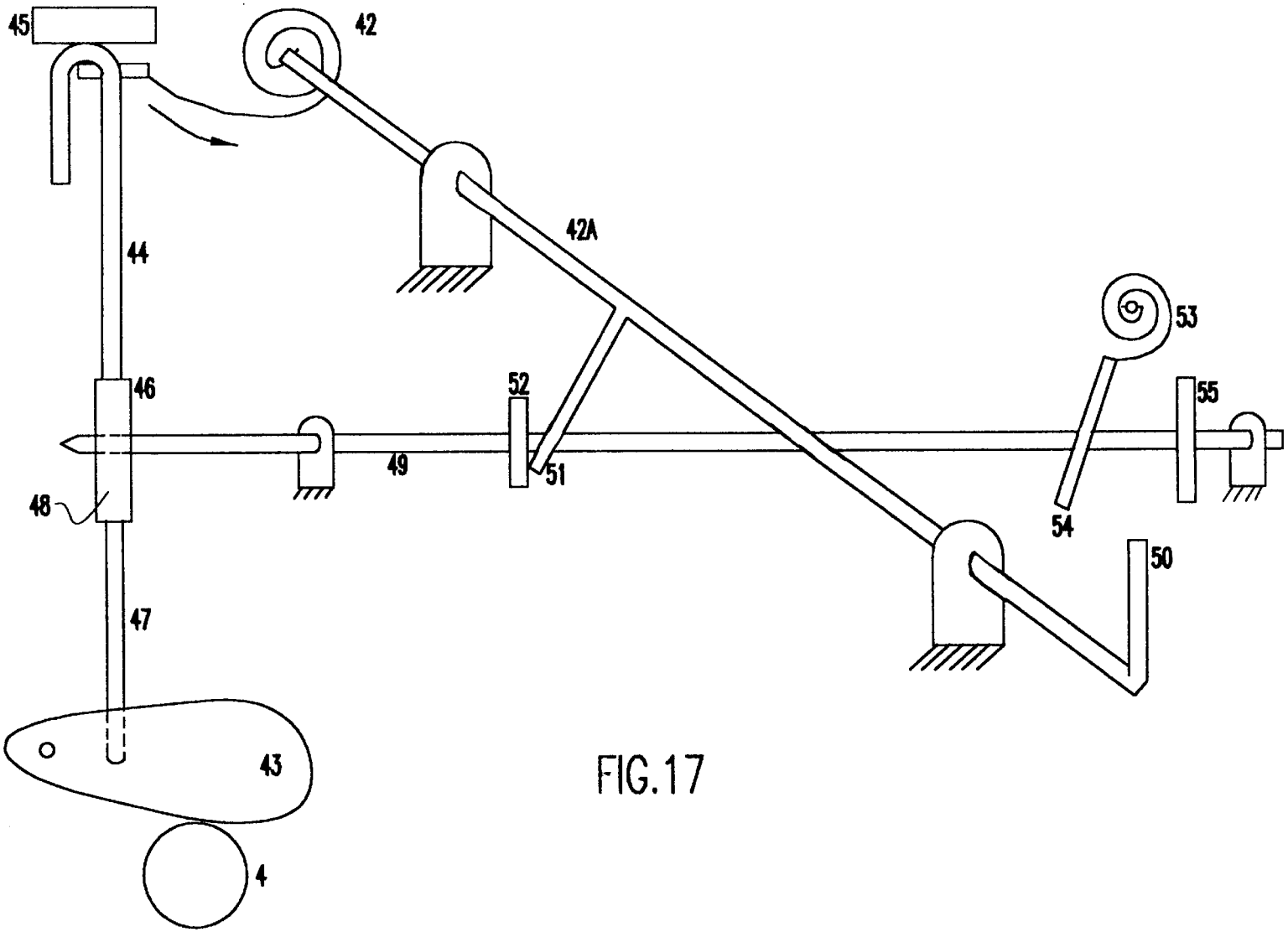
FIG. 17 is a mechanism for giving a temporary high setting of the combustion air.

Referring to FIG. 17, a temporary air setting mechanism is provided so that the proper air setting is maintained until the solid fuel becomes fully involved in the combustion process. Specifically, FIG. 17 shows a rod 42*a* attached to a bimetallic coil 42 and a heat setting handle 50. A rod 44 is hung over an outer end of the bimetallic coil 42 so that when the bimetallic coil 42 pulls the rod 44 upward, the shutter 43 uncovers the end of the lower air tube 4. This mechanism allows more air to enter into the combustion system and increases the combustion rate and heat output of the combustion system. A stop 45 is positioned above the rod 44 and prevents the bimetallic coil 42 from raising the rod 44 beyond its highest position.

A metal plate link 46 is connected to the second rod 44 at a distance from the stop 45. The metal plate link 46 also connects to a shutter actuating rod 47 which, in turn, is connected to the shutter 43, which in preferred embodiments pivots about its left end. The metal plate link 46 includes a hole 48 which aligns with a locking rod 49 when the top end of the rod 44 is against the stop 45 and the shutter 43 is at its maximum open position.

During normal combustion system operation when the locking rod 49 is not engaged and therefore a temporary high setting is not being maintained, the bimetallic coil 42 regulates the heat output of the combustion system by opening and closing the air shutter 43. At the time of fuel reloading, the heat setting handle 50 is rotated clockwise (or counterclockwise depending on the configuration of the system), and the outer end of the bimetallic coil 42 raises the second rod 44 until the end of the second rod 44 contacts the stop 45. The shutter 43 is now in its maximum open position.

Further clockwise rotation causes a fork 51 to push a collar 52 leftward, thus moving the locking rod 49 into the hole 48 and locking the shutter 43 (and any other air controls linked to it) in its maximum open position. Once the locking rod 49 is engaged in the hole 48, the heat setting handle 50 is rotated counterclockwise (or clockwise depending on the configuration of the system) to set the bimetallic coil 42 to the position that will give the appropriate heat output after the locking rod 49 is pulled out of the hole 48. In the preferred embodiment, the heat setting handle 50 is interlocked to the door frame 10 so that the heat setting handle must be fully rotated in order to open the door.

A bimetallic unlocking coil 53 is located proximate to the locking rod 49 and is mounted so that it can sense a temperature that indicates the fuel is adequately engaged in the combustion process. In one embodiment, the bimetallic unlocking coil 53 senses pre-catalyst gas temperature and when this temperature reaches a predetermined value, the fork 54 pushes the collar 55 to the right, thus causing the locking rod 49 to release the link 46. By using this mechanism, the shutter 43 returns to the thermostatic control (or a fixed air setting if the combustion system is not thermostat-equipped). To reduce the chance that a sudden change in air setting causes a spike of emissions from a temporary fuel-rich condition, a damper can be used to slow the transition from the high air setting to the user-selected thermostatic setting.

A timer may also be provided in order to change the heat output of the stove. Also, an alarm may also be provided to indicate when the stove needs refueling.

Alternate Fuel Loading Door

When a batch-fired combustion system or, for example, a wood-fired heater is reloaded, the typical practice is to open the loading door which allows an order of magnitude increase in the air flowing through the combustion system. This large airflow cools the catalysts and other components that rely on high temperatures to reduce emissions. Also, smoke spillage is likely to occur when the loading door is open. Thus, the reloading period is a source of increased emissions through the stack and into the living space.

Figure 18A:
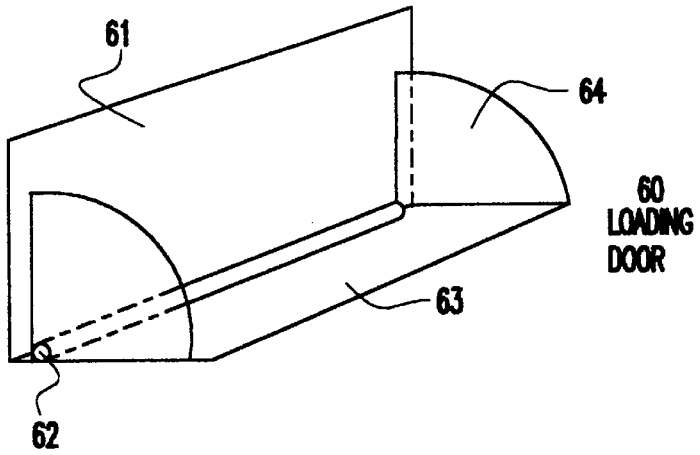
FIGS. 18*a*–18*d* is an alternative loading door of the combustion system of the present invention.

FIGS. 18*a*–18*d* show an alternate loading door 60 which prevents increased emissions and smoke spillage. Referring to FIG. 18*a*, the loading door 60 includes an outer panel 61 and an inner panel 63. The inner panel 63 is connect to the outer panel 61 by a hinged mechanism 62 and is positioned approximately perpendicular (e.g., 90 degrees) with respect to the outer panel 61. The inner panel 63 acts as a fuel support panel 63 and the hinged mechanism 62 is preferably a spring or counterweight so that when solid fuel is supported by the inner support panel 63, the inner support panel 63 no longer maintains a substantially 90 degree angle with respect to the outer panel 61, but now maintains a larger angle, such as, for example only, 120 degrees or greater. This allows the loaded solid fuel to be dispensed from the loading door 60 into the primary combustion chamber 200.

Figure 18B:
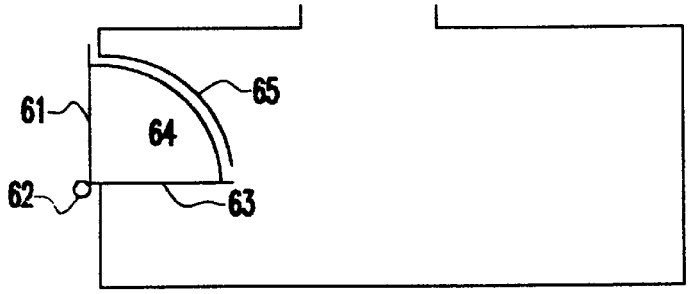

Referring to FIG. 18*b*, the loading door 60 is mounted to the combustion system. In preferred embodiments, the loading door 60 is mounted on either side of the combustion system and is able to accommodate a number of different diameter and length wood logs, or other solid fuel material. For some combustion system designs, spillage control panel 65 is provided to assure that smoke spillage does not occur during loading of the solid material. When the spillage control panel 65 is used, minimal clearance between the spillage control panel 65 and the inner support panel 63 is provided.

Figure 18C:
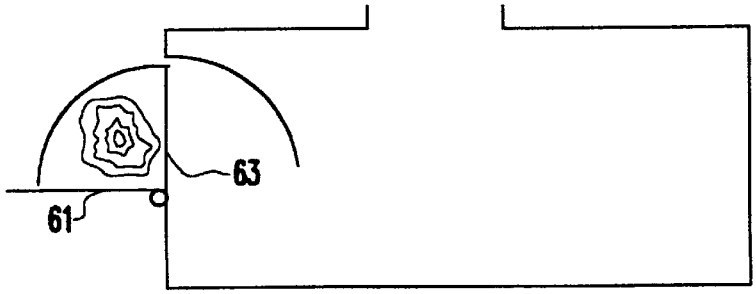

FIG. 18*c* shows the loading door 60 in the open position and loaded with solid fuel, and in this particular example, a log. In this position, the inner support panel 63 is substantially flush with the face of the combustion system and the outer panel 61 is at a substantially 90 degree angle with respect to the face of the combustion system.

Figure 18D:
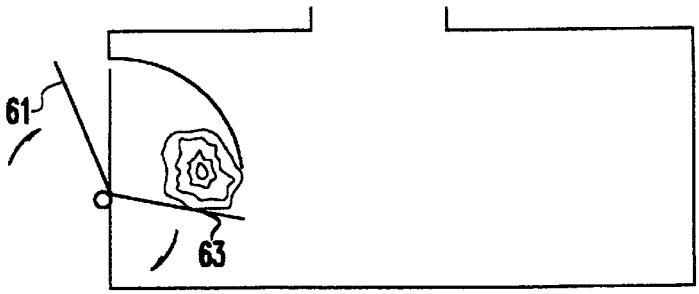

FIG. 18*d* shows the loading door 60 partially closed and the inner support panel 63 extending past a 90 degree angle with respect to the outer panel 61 so that the solid fuel can be dispensed within the combustion chamber. The inner support panel 63 extends past 90 degrees due in part to the hinged mechanism 62 biasing downward from the weight of the solid fuel (i.e., the weight of the solid fuel overcomes the force of the spring or counterweight that otherwise keeps the inner support panel 63 perpendicular to outer surface 61). When the solid fuel is dispensed into the combustion system, the inner support panel 63 returns to its original position (e.g., perpendicular to the outer panel 63)

When the combustion chamber is full and the operator attempts to load further solid fuel within the combustion chamber, the solid fuel remains in the closed loading door 60 until the fuel in the combustion chamber burns so that the fuel support panel 63 can dispense the solid fuel into the combustion chamber. Also, by using the alternate loading door 60 of FIGS. 18*a*–18*d*, the bypass system is no longer required for reloading because (i) cool air is no longer introduced into the combustion system and (ii) smoke spillage into the living space no longer occurs.

Alternate Electronic Control System

An alternate electronic control system for stove adjustments is contemplated for this and other solid fuel heaters. In order to allow more precision in fuel/air ratio control, catalyst over temperature control, stove thermostatic setting, and control of a temporary higher air setting after reloads, an electronic logic device sensing temperatures and changing air shutter positions based on these temperatures is provided. Bimetallic coils as discussed previously for these control systems have been found to work well; however the location, linkage, and stove design can constrain the design flexibility. These mechanical actuating devices are sensitive to system thermal mass, external air flows around the bimetallic coils, and are limited in travel and methods of linkage to actuating arms. The electronic controller may be located in any convenient location as it receives electrical inputs from temperature and/or air/fuel sensing devices and then can electrically control servo motors, solenoids or other electrically activated actuators which in turn actuate the appropriate air shutters or air metering devices. Time response and sensitivity to temperature fluctuations are vastly improved with electronic control relative to purely mechanical control. The control system may be powered by battery, thermal generators, or by available line current or combinations of the three.

Fuel/air ratio control is achieved by electronically sensing the temperature of the combustion gas stream leaving the primary combustion chamber 200. As the temperature increases, the logic device, through servo activation, increases the air flow to the secondary air tube located above the primary combustion chamber 200. Alternatively, fuel/air ratio may be sensed directly using an automotive type fuel/air sensor which provides an electronic signal related to the fuel/air ratio of the gas stream. Air flow through the secondary air tube is increased or decreased based on this signal. For catalyst over-temperature control, the temperature downstream of the catalyst 23 is sensed and diluting air supplied to the secondary air tube and upstream of the catalyst 23 may be increased to maintain the catalyst temperature below a preprogrammed temperature.

To maintain a temporary higher air setting after stove reloading and until new fuel is well lit, the logical controller senses door and/or bypass opening with a proximity sensor or a microswitch attached to the door. After sensing a door opening the primary air setting would be adjusted by servo motor to its high setting until the temperature of the gas stream downstream of the primary combustion chamber 200 is high enough to indicate adequate ignition of the new fuel. An operator activated button is also contemplated which would allow the stove operator to set a temporary higher air setting without opening the stove loading door or bypass.

Electronic thermostatic control of stove heat output is also incorporated in the control system. An electronic temperature sensing device would adjust primary air flow settings in order to maintain a user selected stove temperature and heat output schedule.

Pre-Catalyst Temperature Control

In some instances, particularly at very low fuel burning rates, the gas stream temperature approaching the catalytic combustor can become too low, resulting in a quenching of the catalyst 23. If the gas stream is too cool catalytic activity may cease. With this in mind, a control system which maintains the catalyst approach stream above a critical temperature (about 200 degrees C.) is contemplated for use with the present invention. Sensing this approach stream temperature, a bimetallic coil or electronic control circuit would be linked to the primary air control shutter and increase the air flow to increase the burn rate and thereby increase the temperature of the gas stream flowing toward the catalyst. In this way catalytic activity is assured and pollutant emissions are minimized. No primary air control is needed unless the temperature of the approach stream is below the critical temperature.

Electrically Heated Catalyst

Electrical heating of a catalyst substrate is another means of ensuring catalytic activity, particularly at very low burn rates when the gas stream is relatively cool. Other catalyst heating systems have been used (primarily in the automotive industry); however most attempt to heat the catalytic substrate by using electrically conductive catalytic substrates. In a wood stove, enough chemical energy exists in the gas stream so that once lit, a catalyst can sustain sufficient catalytic temperatures and no additional electrical input is needed. With this realized, only the inlet surface of the catalyst needs to be heated. Only the surface (and not the core) requires heating to initiate catalytic combustion which then propagates through the length of the catalyst.

Figure 19:
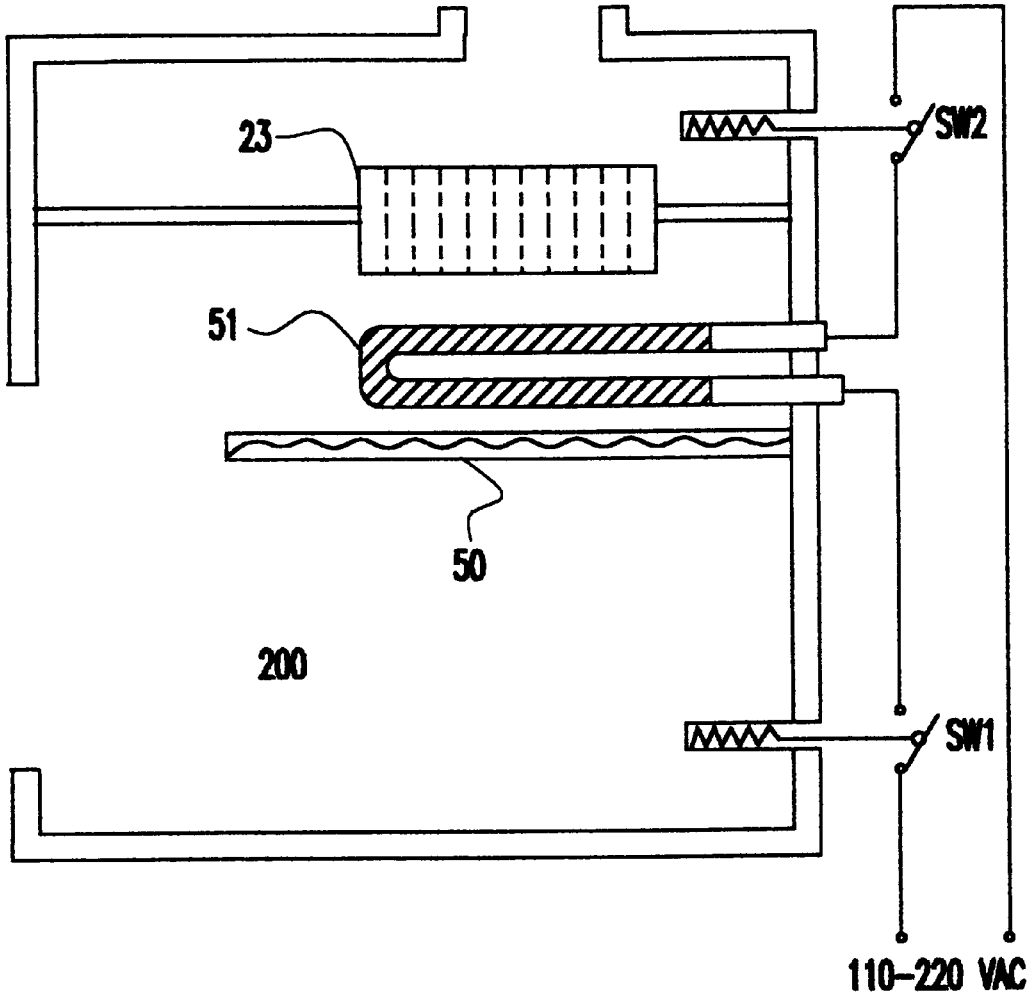
FIG. 19 is catalyst heater system of the present invention.

FIG. 19 shows the catalyst heating system for a solid fuel heater. The inlet surface of the catalyst substrate is heated by a resistance heating element 51 (similar to an electric stove top burner which has been found to work well) which is located just prior to the catalyst 23. In this way the catalyst surface is heated radiantly and the gas stream flowing around the resistance element is heated convectively. An insulating panel below the heating element 51 serves to prevent radiant heat losses from the opposing side of the heating element, thereby reducing electrical energy input to the system. The inlet surface and gas stream need only to be heated enough to initiate sustained catalytic activity.

The control system energizes the resistive heating element 51 only under conditions when electrical energy input is necessary, thus reducing electrical consumption. Controls comprise two thermally activated switches (switch 1 and switch 2) which are wired in series or alternatively, a logic circuit provided with temperature sensing inputs and a high voltage output energizing the heating element. In order for the heating element to energize, two conditions must be met: 1) the stove must be in operation as indicated by temperature sensing inside the primary combustion chamber and 2) the catalyst temperature must be below a predetermined point (about 200 degrees C.) as determined by temperature measurement of the catalyst substrate or the temperature of the gas stream leaving the catalyst.

The control system employing two temperature switches is shown in FIG. 19. When the stove is in operation temperature switch 1 senses a higher than ambient temperature indicating a fire is present and closes. If the catalyst temperature is above the temperature switch 2 setpoint, switch 2 remains open and the heating element is not energized. If the temperature at switch 2 is below the setpoint, switch 2 closes and completes the circuit to energize the heating element thereby ensuring catalytic activity. Once the catalyst is sufficiently heated, switch 2 opens and de-energizes the circuit. Similarly, if the fire goes out, the switch 1 would open and de-energize the heating element.

While the invention has been described in terms of a single preferred embodiment, those skilled in the art will recognize that the invention can be practiced with modification within the spirit and scope of the appended claims.

Having thus described our invention, what we claim as new and desire to secure by Letters Patent is as follows:

1. A combustion system for burning solid fuels, comprising:

a primary combustion chamber defined by a firebox floor, side walls and a ceiling;

fuel retaining standards dividing the primary combustion chamber into separate sections;

a canyon having a first end and a second end, the canyon being located within the primary combustion chamber and being defined by at least one fuel retaining standard, the first end of the canyon being proximate to the firebox floor;

an air delivery system being positioned proximate to the first end of the canyon, and a lower air tube having a plurality of holes positioned proximate to the firebox floor, the holes of the lower air tube are low velocity holes and high velocity holes, the high velocity holes are directed towards the solid fuel in the first and second section of the primary chamber and the low velocity air tubes are directed substantially within the canyon, wherein the fuel-retaining standards and the firebox floor direct the burning solid fuel toward a bottom of a canyon while retaining non-burning solid fuel outside the chamber in order to prevent quenching and smothering of the combustible gases within the canyon, wherein the canyon permits flames to travel substantially unimpeded from the firebox floor of the primary combustion chamber to the ceiling of the primary combustion chamber.

2. The combustion system of claim 1, further comprising an air-cooled loading door positioned on one of the side walls of the primary combustion chamber, the loading door having a plurality of openings which allow air to enter the primary combustion chamber proximate to a fire-facing side of the window.

3. The combustion system of claim 1, wherein the fuel-retaining standards are hollow and at least one of (i) deliver air to different regions of the primary combustion chamber, (ii) deliver combustion gases from the firebox floor to the ceiling of the primary combustion chamber and (iii) deliver heated air to a space around a heater, thereby keeping the fuel-retaining standards cool.

4. The combustion system of claim 1, wherein the fuel-retaining standards lean in one of an outward direction and an inward direction and a vertical direction with relation to the side walls.

5. The combustion system of claim 1, further comprising a secondary combustion chamber positioned substantially over or alongside the primary combustion chamber, the primary combustion chamber and the secondary combustion chamber being divided by at least one baffle or side wall, respectively.

6. The combustion system of claim 5, wherein the at least one baffle slopes upward toward a center of the combustion system so that at least one of (i) if flaming occurs between the solid fuel and the baffles, buoyancy moves the flames and the combustion gases away from burning solid fuel thereby reducing a gasification rate and (ii) preventing cooler secondary combustion chamber gases from dropping into the primary combustion chamber where the cooler secondary combustion chamber gases increase burn rate.

7. The combustion system of claim 5, wherein the at least one baffle includes an opening so that combustion gases and air can communicate between the secondary combustion chamber and the primary combustion chamber.

8. The combustion system of claim 5, wherein the canyon extends from the firebox floor past the at least one baffle into the secondary combustion chamber and is further defined by one of (i) two fuel retaining standards and (ii) one of the fuel retaining standards and one of the side walls or a back wall or a front wall of the primary combustion chamber.

9. The combustion system of claim 1, further comprising a diffuser positioned proximate to the lower air tube, the diffuser being positioned so that a flow path is created which results in low velocity air created by the diffuser.

10. The combustion system of claim 1, wherein the firebox floor is sloped downward and has at least one opening in a center of the firebox floor, wherein the canyon is positioned substantially over the center of the firebox floor.

11. The combustion system of claim 1, further comprising a plenum communicating with the air delivery system, wherein the plenum substantially eliminates smoke emissions from back puffing.

12. A combustion system for burning solid fuels, comprising:

primary combustion chamber defined by a firebox floor, side walls and a ceiling;

a secondary combustion chamber positioned substantially over or alongside the primary combustion chamber, the primary combustion chamber and the secondary combustion chamber being divided by at least one baffle or side wall, respectively;

fuel retaining standards dividing the primary combustion chamber into separate sections;

a canyon having a first end and a second end, the canyon being located within the primary combustion chamber and being defined by at least one fuel retaining standard, the first end of the canyon being proximate to the firebox floor; and an air delivery system being positioned proximate to the first end of the canyon, wherein the fuel-retaining standards and the firebox floor direct the burning solid fuel toward a bottom of a canyon while retaining non-burning solid fuel outside the chamber in order to prevent quenching and smothering of the combustible gases within the canyon, wherein the canyon permits flames to travel substantially unimpeded from the firebox floor of the primary combustion chamber to the ceiling of the primary combustion chamber, wherein the air delivery system includes a lower air tube having a plurality of holes and an upper air tube having a plurality of holes, the upper air tube being positioned in the secondary chamber and the lower air tube being positioned proximate to the firebox floor, the holes of the upper air tube face towards a ceiling of the secondary combustion chamber and circulate combustion gases entering into the secondary combustion chamber, the holes of the lower air tube eject low velocity air and high velocity air, the high velocity air is directed towards the solid fuel of the primary chamber and the low velocity air is directed substantially within the canyon.

13. The combustion system of claim 9, further comprising a diffuser positioned proximate to the lower air tube, the diffuser being positioned so that the flow area is greater than a flow area of the holes of the lower air tube, whereby the low velocity air is created by the diffuser.

14. The combustion system of claim 9, wherein:

the upper air tube further cools a catalyst downstream of the secondary combustion chamber, and the combustion system further comprises a catalyst over temperature and air fuel ratio control system controlling air flow through the upper air tube.

15. The combustion system of claim 11, wherein the catalyst over temperature and air fuel ratio control system comprises:

a shutter regulating air flow passing through the upper air tube; and a bimetallic coil being attached to a mounting rod that protrudes downstream of the catalyst, wherein the bimetallic coil, the mounting rod, and the shutter are kinematically and thermally designed to open the shutter rapidly as post-catalyst temperature exceeds a predefined temperature.

16. A combustion system for burning solid fuels, comprising:

a primary combustion chamber defined by a firebox floor, side walls and a ceiling;

fuel retaining standards dividing the primary combustion chamber into separate sections;

a canyon having a first end and a second end, the canyon being located within the primary combustion chamber and being defined by at least one fuel retaining standard, the first end of the canyon being proximate to the firebox floor;

an air delivery system being positioned proximate to the first end of the canyon; and a bypass system being positioned proximate to a loading door of the primary combustion chamber so that when the loading door is in an open position, combustion gases bypass a catalyst so that pollutants are not released into the indoors, wherein the fuel-retaining standards and the firebox floor direct the burning solid fuel toward a bottom of a canyon while retaining non-burning solid fuel outside the chamber in order to prevent quenching and smothering of the combustible gases within the canyon, wherein the canyon permits flames to travel substantially unimpeded from the firebox floor of the primary combustion chamber to the ceiling of the primary combustion chamber.

17. The combustion system of claim 16, wherein the bypass system comprises:

a bypass plate connected to a handle for opening and closing the bypass;

an L-shaped link; and an I-shaped link; and a rod connecting the L-shaped link to the I-shaped link, wherein in a closed position the I-shaped link contacts a corner of the bypass plate and the L-shaped link is positioned away from any portion of the bypass plate so that a horizontal leg of the L-shaped link is positioned away from a loading door of the primary combustion chamber, wherein in an open position the bypass plate contacts the L-shaped link so that the horizontal leg of the L-shaped link pivots and interferes with the closing of the loading door.

18. A combustion system for burning solid fuels, comprising:

a primary combustion chamber defined by a firebox floor, side walls and a ceiling;

fuel retaining standards dividing the primary combustion chamber into separate sections;

a canyon having a first end and a second end, the canyon being located within the primary combustion chamber and being defined by at least one fuel retaining standard, the first end of the canyon being proximate to the firebox floor;

an air delivery system being positioned proximate to the first end of the canyon;

a catalyst positioned above the ceiling of the primary combustion chamber, the catalyst being mounted by a mounting mechanism including:

a side support having a flange, the side support surrounding a periphery of the catalyst;

a bottom support rod positioned underneath the catalyst;

a panel, the flange fitting into the panel and forming a seal around the panel; and protruding ribs centering the catalyst within the side support so that the exposed exterior surface area of the catalyst is maximized, wherein the fuel-retaining standards and the firebox floor direct the burning solid fuel toward a bottom of a canyon while retaining non-burning solid fuel outside the chamber in order to prevent quenching and smothering of the combustible gases within the canyon, wherein the canyon permits flames to travel substantially unimpeded from the firebox floor of the primary combustion chamber to the ceiling of the primary combustion chamber.

19. A combustion system for burning solid fuels, comprising:

a primary combustion chamber defined by a firebox floor, side walls and a ceiling;

fuel retaining standards dividing the primary combustion chamber into separate sections;

a canyon having a first end and a second end, the canyon being located within the primary combustion chamber and being defined by at least one fuel retaining standard, the first end of the canyon being proximate to the firebox floor;

an air delivery system being positioned proximate to the first end of the canyon; and an automatic air setting mechanism positioned proximate to the air delivery system, the automatic air setting mechanism providing a proper air setting until unburned solid fuel becomes fully involved in the combustion process, wherein the fuel-retaining standards and the firebox floor direct the burning solid fuel toward a bottom of a canyon while retaining non-burning solid fuel outside the chamber in order to prevent quenching and smothering of the combustible gases within the canyon, wherein the canyon permits flames to travel substantially unimpeded from the firebox floor of the primary combustion chamber to the ceiling of the primary combustion chamber.

20. A combustion system for burning solid fuels, comprising:

a primary combustion chamber defined by a firebox floor, side walls and a ceiling;

a secondary combustion chamber positioned substantially over the primary combustion chamber;

at least one baffle separating the primary combustion chamber from the secondary combustion chamber, where the at least one baffle includes an opening that allows combustion gases to flow from the primary combustion chamber into the secondary combustion chamber;

an air delivery system delivering both high velocity air and low velocity air, the air delivery system being positioned in the primary combustion chamber and the secondary combustion chamber, the air delivery system in the primary combustion chamber delivering both high velocity air and low velocity air, the air delivery system in the secondary combustion chamber delivering at least high velocity air that mixes combustion gases in the secondary combustion chamber, wherein the baffles slope upward toward a center of the combustion system so that at least one of (i) if flaming occurs between solid fuel and the baffles, buoyancy moves the flames and combustion gases away from the solid fuel thereby reducing gasification rate and (ii) preventing cooler secondary combustion chamber gases from dropping into the primary combustion chamber where the cooler secondary combustion chamber gases increase burn rate.

21. The combustion system of claim 20, wherein the primary combustion chamber includes a firebox floor sloping downward and having an opening in a center.

22. The combustion system of claim 21, further comprising a plenum communicating with the air delivery system, wherein the plenum substantially eliminates smoke emissions from back puffing.

23. The combustion system of claim 21, further comprising a bypass system being positioned proximate to a loading door of the primary combustion chamber so that when the loading door is in an open position, combustion gases can bypass a catalyst so that pollutants are not released into the indoors, the bypass system comprises:

a bypass plate connected to a handle for opening and closing the bypass;

an L-shaped link;

an I-shaped link; and a rod connecting the L-shaped link to the I-shaped link, wherein in a closed position the I-shaped link contacts a corner of the bypass plate and the L-shaped link is positioned away from any portion of the bypass plate so that a horizontal leg of the L-shaped link is positioned away from a loading door of the primary combustion chamber, wherein in an open position the bypass plate contacts the L-shaped link so that the horizontal leg of the L-shaped link pivots and interferes with the closing of the loading door.

24. The combustion system of claim 21, further comprising an automatic air setting mechanism positioned proximate to the air delivery system, the automatic air setting mechanism providing a proper air setting until unburned solid fuel becomes fully involved in the combustion.

25. A combustion system for burning solid fuels, comprising:

a primary combustion chamber defined by a firebox floor side walls and a ceiling;

a secondary combustion chamber positioned substantially over the primary combustion chamber;

at least one baffle separating the primary combustion chamber from the secondary combustion chamber where the at least one baffle includes an opening that allows combustion gases to flow from the primary combustion chamber into the secondary=combustion chamber;

an air delivery system delivering both high velocity air and low velocity air, the air delivery system being positioned in the primary combustion chamber and the secondary combustion chamber, the air delivery system in the primary combustion chamber delivering both high velocity air and low velocity air, the air delivery system in the secondary combustion chamber delivering at least high velocity air that mixes combustion gases in the secondary combustion chamber;

fuel retaining standards dividing the primary combustion chamber into sections, the fuel retaining standards forming a flow pattern entering into the secondary combustion chamber through the baffles; and a canyon having a first end and a second end, the canyon being positioned within one of (i) the fuel retaining standards and (ii) one fuel retaining standard and one of the side walls of the primary combustion chamber, where the first end is located in the primary combustion chamber and the second end is located substantially at an entrance to the secondary combustion chamber.

26. The combustion system of claim 23, wherein the fuel-retaining standards are hollow and at least one of (i) deliver air to different regions of the primary combustion chamber, (ii) deliver combustion gases from the firebox floor to the ceiling of the primary combustion chamber and (iii) deliver heated air to a space around a heater, thereby keeping the fuel-retaining standards cool.

27. The combustion system of claim 23, wherein the air delivery system includes a lower air tube having a plurality of holes and an upper air tube having a plurality of holes, the upper air tube being positioned in the secondary chamber and the lower air tube being positioned proximate to the firebox floor, wherein the holes of the upper air tube face towards a ceiling of the secondary combustion chamber and circulate combustion gases entering into the secondary combustion chamber, wherein the holes of the lower air tube are low velocity holes and high velocity holes, the high velocity holes are directed towards the solid fuel in the first and second section of the primary chamber and the low velocity air tubes are directed substantially within the canyon.

28. The combustion system of claim 25, further comprising a diffuser positioned proximate to the lower air tube, the diffuser being positioned so that the flow area is greater than a flow area of the holes of the lower air tube, whereby low velocity air is created by the diffuser.

29. The combustion system of claim 25, further comprising a catalyst over temperature control system and air fuel ratio control system controlling the upper air tube, wherein the catalyst over temperature and air fuel ratio control system comprises:

a shutter regulating air flow passing through the upper air tube; and a bimetallic coil being attached to a mounting rod that protrudes downstream of the catalyst, wherein the bimetallic coil, the mounting rod, and the shutter are kinematically and thermally designed to open the shutter rapidly as post-catalyst temperature exceeds a predefined temperature.

30. A combustion system for burning solid fuels, comprising:

a combustion chamber defined by a firebox floor, side walls and a ceiling;

a canyon having being located within the combustion chamber;

an air delivery system being positioned within the combustion chamber, the air delivery system including a lower air tube having a plurality of holes positioned proximate to the firebox floor, the holes of the lower air tube are low velocity holes and high velocity holes, the high velocity holes are directed towards the solid fuel in the chamber and the low velocity air tubes are directed substantially within the canyon;

a catalyst located proximate to the combustion chamber;

upper air means for cooling the catalyst, the upper air means being positioned proximate to the catalyst; and catalyst over temperature and air fuel ratio control means for controlling the upper air means for cooling the catalyst.

* * * * *